United States Patent [19]

Kato

[11] Patent Number: 4,713,016

[45] Date of Patent: Dec. 15, 1987

[54] JACK FOR TELEPHONE SET

[75] Inventor: Yutaka Kato, Mie, Japan

[73] Assignee: Matsushita Electric Works, Ltd., Osaka, Japan

[21] Appl. No.: 1,863

[22] Filed: Jan. 9, 1987

[30] Foreign Application Priority Data

Jan. 27, 1986 [JP] Japan ..... 61-15006

[51] Int. Cl.[4] ..... H01R 13/44

[52] U.S. Cl. ..... 439/137; 439/140

[58] Field of Search ..... 439/136–140, 439/142, 143, 145

[56] References Cited

U.S. PATENT DOCUMENTS

| | | | |
|---|---|---|---|
| 3,865,456 | 2/1975 | Dola | 439/137 |
| 4,188,082 | 2/1980 | Dickey | 439/145 |
| 4,549,778 | 10/1985 | Price et al. | 439/137 |
| 4,600,258 | 7/1986 | Hu | 439/140 |
| 4,624,516 | 11/1986 | White | 439/140 |
| 4,640,564 | 2/1987 | Hill | 439/137 |

FOREIGN PATENT DOCUMENTS 49-9985 9/1974 Japan .

*Primary Examiner*—Gil Weidenfeld
*Assistant Examiner*—Paula A. Austin
*Attorney, Agent, or Firm*—Burns, Doane, Swecker & Mathis

[57] ABSTRACT

A jack for a telephone set comprises a dust-proof closure unit having a first cover plate provided with a guide groove extended in a sliding direction and a second cover plate provided with a guiding projection engageable in the guide groove of the first plate, the first and second cover plates being arranged slidable relative to each other along a plug receiving aperture in a casing of the jack to close or open the aperture, whereby the first and second cover plates of the closure unit can be retracted as overlapped with each other to their aperture opening position so as to reduce their retractive dimension substantially to be half in the sliding direction, and the dust-proof closure unit can be provided for the plug receiving aperture without any increase in size of the casing.

5 Claims, 18 Drawing Figures

JACK FOR TELEPHONE SET

TECHNICAL BACKGROUND OF THE INVENTION

This invention related to a jack for telephone sets which, in particular, can perform a function of preventing dust from entering the interior of the jack when it is not used.

The jack of the type referred to incorporates therein terminals for connection of the telephone set to the central office lines and arranged so that, when the jack receives a plug at an end of a cord of the telephone set, plug pins or blades are electrically connected to the terminals in the jack, and is effectively used for such connection of the telephone set of, for example, plug-in type.

DISCLOSURE OF PRIOR ART

Hitherto, there have been suggested various types of measure for the dust entry prevention by means of closing receptacle aperture of the jack. Disclosed, for example, in Japanese Utility Model Publication No. 49-9985 by T. Fukuzawa et al. is of an arrangement in the form of an outlet type connector, in which a receptacle provided to an outlet body is disposed inside an aperture of an outlet cover and a plate having a plurality of holes to be aligned with the receptacle is slidably disposed between the cover and body as resiliently urged by a spring load into a first position where the holes of the plate are out of the alignment. In connecting the plug of the telephone set to the outlet of Fukuzawa et al., therefore, the plate must be moved initially with pins of the plug engaged in the holes of the plate, to a second position of the plate where its holes come into the alignment with the receptacle, and then the plug pins are inserted into the receptacle. When the plug pins are disconnected from the receptacle, the plate is returned by the spring load to the first position, where the receptacle is closed by other parts of the plate than the holes which are now non-alignment with the receptacle, to be dust-proof.

The connector of Fukuzawa et al. has been satisfactory where it is sufficient to have the plate slid between the outlet cover and body only by a small distance for closing the receptacle of a size and configuration just corresponding to a single plug pin or two closely disposed plug pins generally of a rod shape in the outlet.

In the case of the jack for the telephone set, however, the jack is arranged to accommodate substantially the entire body of the plug of the telephone set, required receptacle aperture made therefor in the front wall of the jack becomes considerably large, and there arises a problem when such large aperture is attempted to be opened and closed by a slidable plate in a limited area of front wall of the jack. While such large aperture may be made closable by enlarging the outer dimensions of the jack by an amount corresponding to required sliding distance of the plate, this will result in a problem that an unduly enlarged jack body is not adaptable to a modular coordination with such other type modular wiring appliances as the outlet and so on to be installed on a single wiring-appliance mounting frame together with them.

TECHNICAL FIELD OF THE INVENTION

A primary object of the present invention is, therefore, to provide a jack for a telephone set which can be closed at a plug receiving aperture during non-use, without any outer dimensional enlargement, so as to be sufficiently dust-proof, be readily subjected to the modular coordination with any other type wiring appliances.

According to the present invention, this object is realized by providing a jack for a telephone set which comprises a casing having an aperture for receiving a cord plug of the telephone set, and a dust-proof closure unit provided in the casing to be movable along the plug receiving aperture within the casing for opening and closing the aperture, wherein the closing unit including a pair of first and second cover plates slidable relative to each other, the first plate having a guide groove extended in slidable direction, the second plate having a projection engageable in the guide groove of the first plate, and one of the first and second plates being provided with an operating portion projecting out of the plug receiving aperture of the casing.

Other objects and advantages of the present invention shall become clear from following description of the invention detailed with reference to preferred embodiments shown in accompanying drawings.

Figure 1:
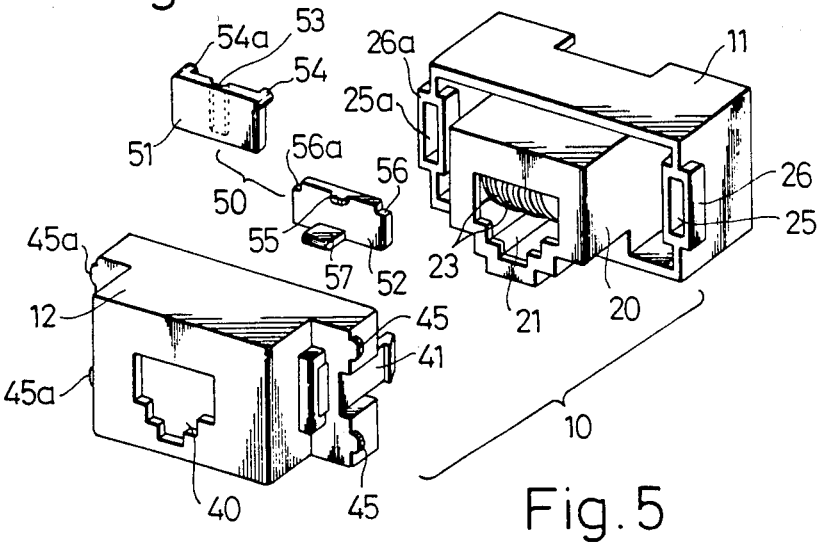
FIG. 1 is a perspective view as disassembled of a jack for a telephone set in an embodiment according to the present invention.

White the present invention shall now be described with reference to the preferred embodiment shown in the drawings, it should be understood that the intention is not to limit the invention only to the particular embodiments shown but rather to cover all alterations, modifications and equivalent arrangements possible within the scope of appended claims.

DISCLOSURE OF PREFFERED EMBODIMENTS

Figure 2:
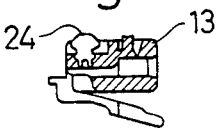
FIG. 2 is a cross-section view of a plug to be inserted into a plug receiving aperture in the jack of FIG. 1.
Figure 3:
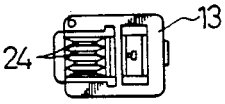
FIG. 3 is a top plan view of the plug of FIG. 2.
Figure 4:
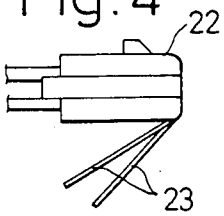
FIG. 4 is a side view of a modular insert disposed within the jack of FIG. 1.
Figure 5:
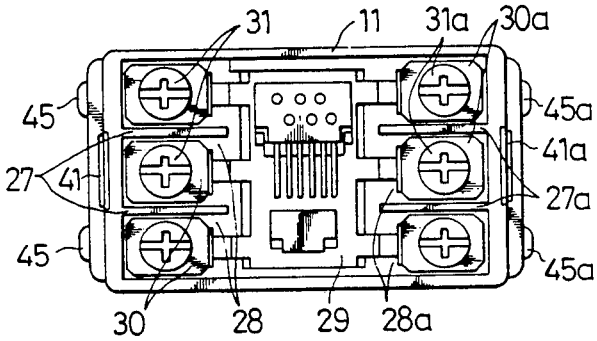
FIG. 5 is a rear view of the jack of FIG. 1, with an insulating plate on its rear side dismounted.
Figure 6:
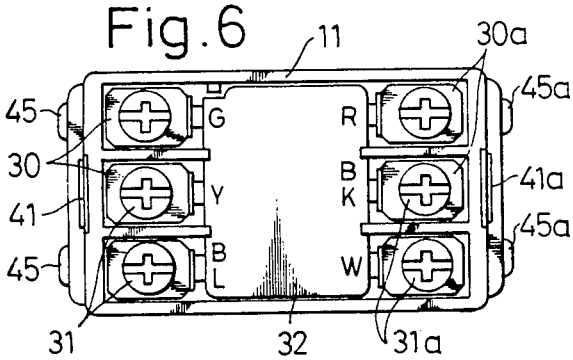
FIG. 6 is also a rear view of the jack of FIG. 1, with the insulating plate mounted.

Referring to FIGS. 1 through 16, a jack for a telephone set according to the present invention comprises a casing 10 formed by an insulating material in an elongated rectangular shape to include a body part 11 and a cover part 12. The body part 11 is provided at its center with a frontward projected plug receptacle 20 which receives a plug 13 (FIG. 2 and 3) at an end of a telephone cord not-shown, and the plug receptacle 20 is provided in front side wall with a plug receiving aperture 21 dimensioned to correspond to the outer dimensions of the plug 13. Fitted into the plug receptacle 20 is a modular insert 22 (FIG. 4) which forms a main electrical connecting part of the jack and from which contact pins 23 are extended rearward right on the rear side of the plug receiving aperture 21 so that, when the plug 13 is fittingly inserted into the aperture 21, the contact pins 23 come into electrical contact with contactors 24 of the plug 13. The body part 11 is also formed to have, at both longitudinal ends, engaging portions 26 and **26*a* respectively having each of engaging holes 25 and 25*a* opened on front side of the body part and, inside both longitudinal ends on rear side, two sets of mutually isolated compartments 28 and 28*a* defined by two sets of partitions 27 and 27*a* extended in parallel to each other from each end wall toward the center but leaving central area open (FIGS. 5 and 6**).

Within the body part 11, there is incorporated a terminal plate 29 which carries thereon two sets of terminal metal fittings 30 and **30*a* to be positioned respectively in each of the compartments 28 and 28*a* and connected to the contact pins 23 of the modular insert 22 through electric paths provided therein. The terminal metal fittings 30 and 30*a* have terminal screws 31 and 31*a*. for connection, to the fittings, of telephone wires provided as, for example, embedded in a building wall or the like structural member by unfastening and fastening these screws 31 and 31*a* (FIG. 5). On the rear side of the body part 11, an insulating plate 32 is fitted to the open central area so as to cover the rear side of the modular insert 22, which insulating plate 32 carries such two sets of alphabetic marks as G, Y, BL and R, BK, W preferably in colors for easy connection of the telephone wires having insulating coats of such different colors as green, yellow, blue and red, black, white, to corresponding ones of the terminal members 30, 31 and 30*a*, 31*a* (FIG. 6**).

Figure 7:
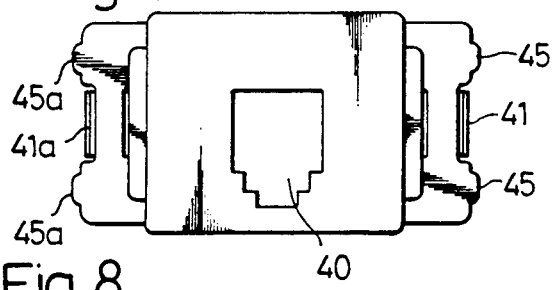
FIG. 7 is a front view of a cover part of the jack of FIG. 1.
Figure 8:
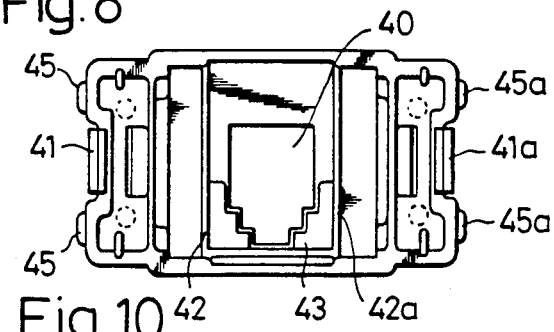
FIG. 8 is a rear view of the cover part of FIG. 7.
Figure 9:
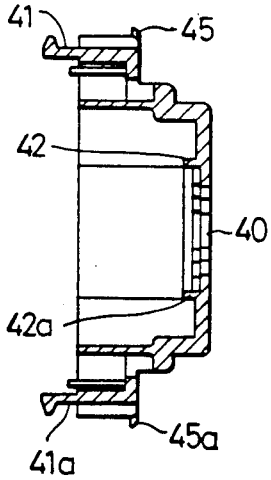
FIG. 9 is a longitudinally sectioned view of the cover part of FIG. 7.
Figure 10:
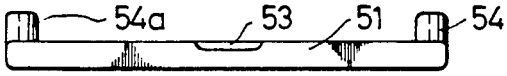
FIG. 10 is a top view as enlarged of a first cover plate of a dust-proof closure unit in the jack of FIG. 1.
Figure 11:
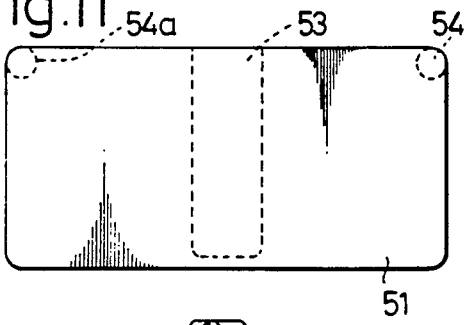
FIG. 11 is a front view of the first cover plate of FIG. 10.
Figure 12:
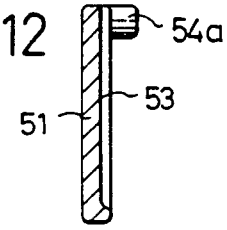
FIG. 12 is a cross-sectional view of the first cover plate of FIG. 10.

On the other hand, the cover part 12 is shaped to have rectangular front and rear portions, the latter of which is dimensioned to correspond to the body part 11, while the former of which is shorter in the longitudinal direction. The front portion of the cover part 12 is provided in its center with a plug receiving aperture 40 of the same shape as that of the plug receiving aperture 21 in the body part 11, the shape corresponding to the outer shape of the plug 13 for its insertion. The rear portion of the cover part 12 is provided at both longitudinal ends with rearwardly-projected linkage legs 41 and **41*a* which are fittingly insertable into the engaging holes 25 and 25*a* in the engaging portions 26 and 26*a* of the body part 11 so that, when the linkage legs 41 and 41*a* are tightly fitted to the engaging portions 26 and 26*a*, the cover part 12 can be coupled to the body part 11 (FIGS. 7 to 9**).

Inwardly-projected holding ribs 42 and **42*a* are provided on an inner front side wall of the cover part 12 at both sides of the plug receiving aperture 40, and a thick wall portion 43 projected rearward by about half of the rearward projected length of the holding ribs 42 and 42*a* is provided on the inner side wall at lower part of the aperture 40, besides stepped edge of the aperture in the present instance. With such arrangement, the cover part 12 coupled to the body part 11 provides a space 44 (FIG. 16) corresponding to the projected length of the holding ribs 42 and 42*a* is secured between the front wall of the plug receptacle 20 of the body part 11 and an inside wall of the front portion of the cover part 12**.

The rear portion of the cover part 12 is provided at front side corners of the both longitudinal ends with projections 45 and **45*a*** which are engageable to a wiring-appliance mounting plate as will be explained later.

As a remarkable feature of the present invention, a unique dust-proof closure unit 50 is provided movably in the space 44 defined between the front wall of the body part 11 and the inside wall of the cover part 12, for closing and opening operation of the plug receiving aperture 21, and this closure unit 50 comprises a pair of first and second cover plates 51 and 52 provided slidable relative to each other (FIGS. 10 to 12 and FIGS. 13 to 15). In the illustrated embodiment, the first cover plate 51 is provided, in its middle part of rear face opposing the second cover plate 52, with a guide groove 53 extended in sliding direction relative to the second cover plate 52 and closed at one end and opened at the other end, while the first cover plate 51 is formed to have rearward projections 54 and **54*a* at both corners on the sides of the open end of the guide groove 53**.

On the other hand, the second cover plate 52 is provided with a forward guide projection 55 in the middle of an edge to slidably engage in the guide groove 53 of the first cover plate, and also with notches 56 and **56*a* in both corners corresponding to those where the first cover plate 51 has the projections 54 and 54*a* for their engagement into the notches. The second cover plate 52 is also formed to have a forwardly projected operating arm 57 in the middle of the other edge than that of the projection 55 so that, when the cover part 12 is mounted on the body part 11, the operating arm 57 forwardly projects out of the cover part 12 through the plug receiving aperture 40 as positioned adjacent the lowermost central part in the stepped edge of the aperture 40**.

Figure 16:
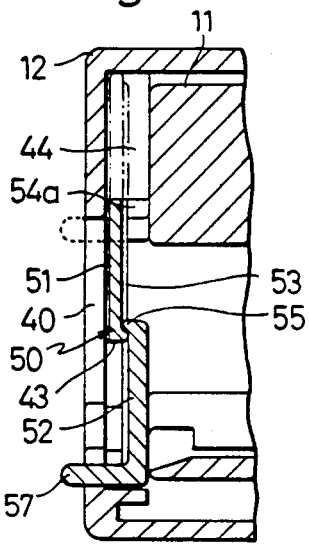
FIG. 16 is a fragmentary cross-sectional view as enlarged of the jack of FIG. 1, for explanation of operational state of the dust-proof closure unit.
Figure 13:
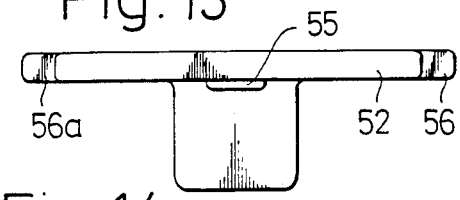
FIG. 13 is a top view as enlarged of a second cover plate of the dust-proof closure unit in the jack of FIG. 1.
Figure 14:
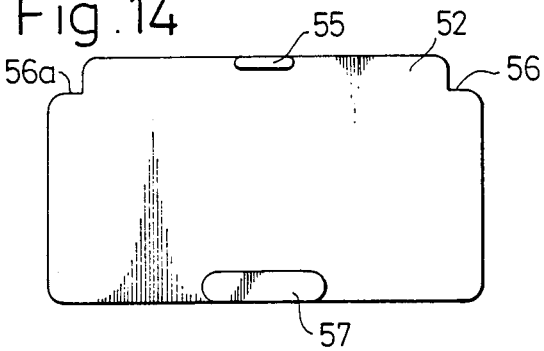
FIG. 14 is a front view of the second cover plate of FIG. 13.
Figure 15:
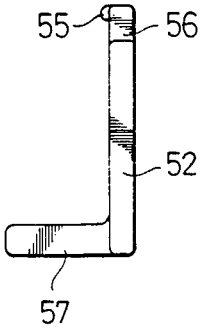
FIG. 15 is a side view of the second cover plate of FIG. 13.

The first and second cover plates 51 and 52 are formed preferably to have substantially the same contour and dimensions so that, when the second plate 52 is disposed behind the first plate 51 with the guide projection 55 engaged in the guide groove 53 in the rear face of the first plate 51 to form the dust-proof closure unit 50, the thickness of the unit 50 in its forward and rearward or plug inserting direction becomes substantially equal to that of the space 44 within the cover part 12 in the same direction (FIG. 16).

The operatin of the dust-proof closure unit 50 according to the present invention will be explained here. In inserting the plug 13 at an end of the telephone cord into the jack of the body part 11 and cover part 12 thus assembled together with the dust-proof closure unit 50 interposed between them, the operating arm 57 of the second cover plate 52 in a position of closing the both apertures 21 and 40 as in FIG. 16 is urged by tip end of the plug 13 to be moved to open the apertures, during which operation the plug 13 itself is urged to be inserted through the apertures into the body part 11 to be mounted therein, upon which, as shown in FIG. 16, the engagement between the guide groove 53 and the guide projection 55 determines the sliding direction of the second cover plate 52 of the unit 50 so that the second plate 52 is slid in a direction (upward in FIG. 16) of overlapping the first plate 51. That is, the second plate 52 is slid in this direction until the projections 54 and 54*a* of the first plate 51 engage in the notches 56 and 56*a* of the second plate 52 to acheive substantially the maximum overlapping state between the first and second plates 51 and 52. In this state, the plug receiving apertures 40 and 21 are substantially fully opened, and the plug 13 can be fully inserted into the body part 11.

When the plug 13 is dismounted from the jack, in contrast to the above, the first and second cover plates 51 and 52 are both made slidable in the opposite direction, which is downward so long as the plates are positioned vertically as in FIG. 16, automatically with their own weight, during which sliding the first plate 51 is caused to initially stop intermediately when the lower edge rests on the uppermost edge of the thick wall portion 43 provided on the inside wall of the plug receiving aperture 40 of the cover part 12 and then only the second plate 52 continues to slide in the same direction until the guide projection 55 reaches the closed end of the guide groove 53 and, at the same time, the lower edge of the second plate 52 rests at its operating arm 57 on the lowermost part in the stepped edge of the plug receiving aperture 40 of the cover part 12. At this stage, the plug receiving aperture 40 as well as the aperture 21 are closed by the dust-proof closure unit 50 with the thus slid first and second cover plates.

It will be appreciated that, after the dismounting of the plug 13 from the jack, the closure unit 50 in its closing state keeps the jack in the dust-proof state. According to the present invention, once the plug receiving aperture 40 of the cover part 12 is closed, the first and second cover plates 51 and 52 are in their minimum overlapping relationship, closing thus the aperture substantially with a sum of the respective effective surface areas of the first and second plates 51 and 52 whereas in the state of opening the aperture 40 the first and second plates 51 and 52 are positioned in their maximum overlapped relationship so as to be substantially of an effective area of only one of the first and second plates 51 and 52. Therefore, it is sufficient that a sliding zone corresponding to the area of only one plate of the unit 50 is secured for the space 44 between the outer wall of the body part 11 and the inner wall of the cover part 12, and the outer dimensions of casing 10, i.e., of the jack can be kept in the minimum.

Figure 17:
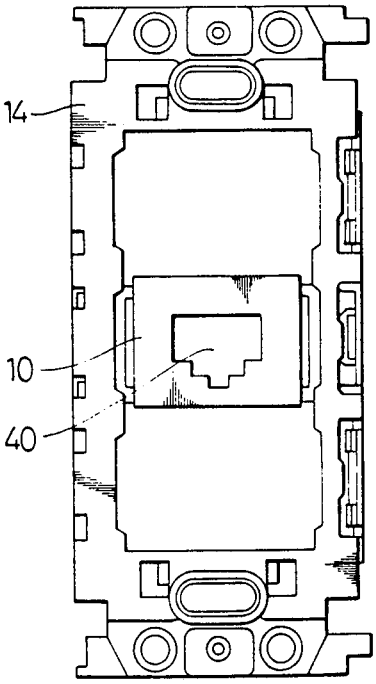
FIG. 17 is a front view of the jack of FIG. 1 as mounted on a mounting frame for installation in a building wall or the like structural member.

It will be readily understood that the thus-minimized jack can be made in the form of the same module as such other sort of the wiring appliance as, in particular, the electrical outlet, so as to be mounted by means of the engaging projections 45 and 45*a* onto a mounting frame 14 as shown in FIG. 17, on which frame three different sorts of modular wiring appliances can be installed in a row, together with any other wiring appliances.

Figure 18:
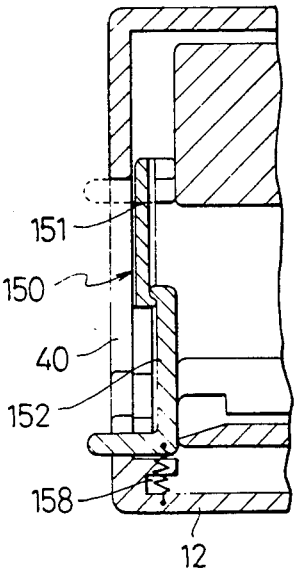
FIG. 18 is a fragmentary cross-sectional view of the jack of the present invention, for explaining operating state of the dust-proof closure unit in another embodiment.

The present invention may be modified in various ways. For example, the first and second cover plates 51 and 52 of the closure unit 50 has been referred to as vertically disposed as shown in FIG. 16, but the first and second plates may be disposed in any other manner depending on the mounting orientation of the mounting frame 14. In this connection, as shown in FIG. 18, a tension spring 158 may be provided between the second plate 152 and the cover part 12 in a similar closure unit 150 having the same arrangement as the above dust-proof closure unit 50, but at a position out of the aperture 40, so that, after the plug 13 is dismounted from the jack, the plug receiving aperture of the cover part 12 can be automatically closed regardless of the mounting orientation of the mounting frame 14 and without depending on the own weight of the cover plates or manual operation. Such arrangement having the tension spring 158 is effective even when the first and second plates 151 and 152 are positioned in the vertical posture, since the spring force eliminates any non-smooth sliding of the plates due to a manufacturing tolerance or the like.

What is claimed as my invention is:

1. A jack for a telephone set comprising a casing having an aperture for receiving a cord plug of said telephone set and a dust-proof closure unit provided to be shiftable along said plug receiving aperture within said casing for opening and closing the aperture, wherein said closure unit including a pair of cover plates slidable relative to each other, said first plate having a guide groove extended in slidable direction, said second plate having a projection engageable in said guide groove of the first plate, and one of the first and second plates being provided with an operating portion projected out of said plug receiving aperture of the casing.

2. A jack according to claim 1, wherein said casing comprises a cover part having said plug receiving aperture and a body part with which said cover part is assembled to define a space inside top wall having said aperture of the covr part and having a thickness in inserting direction of said plug substantially corresponding to a thickness of said closure unit for slidably disposing therein the closure unit.

3. A jack according to claim 1, wherein said casing is positioned vertically to dispose said first and second cover plates of said closure unit in vertically slidable relationship, and said guide groove of the first cover plate is closed at least at lower end.

4. A jack according to claim 1, wherein said first cover plate is formed to have engaging projections at both end corners of an edge on a side of a direction in which the plate is slid to open said plug inserting aperture, said second cover plate is formed to have notches in both end corners of an edge on the same side as said edge of the first cover plate for engaging therein said projections of the first cover plate, and said operating portion is provided to said second cover plate at the other edge thereof.

5. A jack according to claim 1, wherein a spring load is applied to said dust-proof closure unit to urge said first and second cover plates in a direction of closing said plug receiving aperture.

* * * * *